US010857508B2

(12) United States Patent
Kulkarni et al.

(10) Patent No.: US 10,857,508 B2
(45) Date of Patent: Dec. 8, 2020

(54) CONTINUOUS MICRO MIXER

(71) Applicant: COUNCIL OF SCIENTIFIC & INDUSTRIAL RESEARCH, New Delhi (IN)

(72) Inventors: Amol Arvind Kulkarni, Pune (IN); Vivek Vinayak Ranade, Pune (IN)

(73) Assignee: Council of Scientific & Industrial Research, New Delhi (IN)

( * ) Notice: Subject to any disclaimer, the term of this patent is extended or adjusted under 35 U.S.C. 154(b) by 469 days.

(21) Appl. No.: 15/566,020

(22) PCT Filed: Apr. 13, 2016

(86) PCT No.: PCT/IN2016/050108
§ 371 (c)(1),
(2) Date: Oct. 12, 2017

(87) PCT Pub. No.: WO2016/166771
PCT Pub. Date: Oct. 20, 2016

(65) Prior Publication Data

US 2018/0117543 A1 May 3, 2018

(30) Foreign Application Priority Data

Apr. 13, 2015 (IN) ..... 1022/DEL/2015

(51) Int. Cl.
*B01F 5/06* (2006.01)
*B01F 13/00* (2006.01)

(52) U.S. Cl.
CPC ..... *B01F 5/0647* (2013.01); *B01F 5/061* (2013.01); *B01F 5/0655* (2013.01);
(Continued)

(58) Field of Classification Search
CPC ..... B01F 5/0647
(Continued)

(56) References Cited

U.S. PATENT DOCUMENTS 5,904,424 A 5/1999 Schwesinger et al.
6,176,911 B1 * 1/2001 Schwarz ..... C09D 11/38 106/31.43

(Continued)

FOREIGN PATENT DOCUMENTS

WO 01/68257 A1 9/2001
WO 2010/009239 A2 1/2010
WO 2013/059922 A1 5/2013

OTHER PUBLICATIONS

Search Report and Written Opinion for International Application PCT/IN2016/050108 filed Apr. 13, 2016; dated Sep. 21, 2016. ISA/EP.

*Primary Examiner* — David L Sorkin
(74) *Attorney, Agent, or Firm* — Dinsmore & Shohl LLP

(57) ABSTRACT

A multimodal micromixer obstacle for intensification of mixing and performing the reaction in a continuous manner is disclosed herein. The micromixer 100 comprises of plurality of inlets, an outlet and a plurality of channels. The end channels—of the channels, have plurality—of converging sections having width, to depth ratio ranging 1:1 to 20:1. The intermediate channels have at least, one obstacle having non-circular shape. Each converging section is incomplete ellipse, prolate or oblate shaped having, angle of curvature in the range of 90 to 270°. Axes of the inlets are coplanar and perpendicular to the channels. All the components of the micromixer are coplanar.

8 Claims, 8 Drawing Sheets

(52) U.S. Cl.
CPC .. *B01F 13/0059* (2013.01); *B01F 2005/0623* (2013.01); *B01F 2215/0431* (2013.01)

(58) Field of Classification Search
USPC ..... 366/DIG. 1–DIG. 3
See application file for complete search history.

(56) References Cited

U.S. PATENT DOCUMENTS

| | | | | |
|---|---|---|---|---|
| 9,908,117 | B2 * | 3/2018 | Jung | B01L 3/502761 |
| 10,233,482 | B2 * | 3/2019 | Luo | B01F 5/0619 |
| 2005/0276160 | A1 * | 12/2005 | Woehl | B01F 5/0451 366/336 |
| 2006/0087918 | A1 * | 4/2006 | Ji | B01F 5/0646 366/341 |
| 2009/0028763 | A1 | 1/2009 | Lavric et al. | |
| 2014/0146636 | A1 | 5/2014 | Dillion | |
| 2017/0239655 | A1 * | 8/2017 | Laursen | B01F 5/0647 |

* cited by examiner

Figure 10 A, B and C

CONTINUOUS MICRO MIXER

CROSS REFERENCE TO RELATED APPLICATIONS

This application is a 35 U.S.C. 371 national stage filing and claims priority to International Application No. PCT/IN2016/050108 filed on Apr. 13, 2016, entitled "CONTINUOUS MICRO MIXER," which claims the benefit of Indian Patent Application No. 1022/DEL/2015 filed on Apr. 13, 2015, each of which is incorporated herein in its entirety by reference.

FIELD OF INVENTION

The present invention relates to a flow micromixer composed of plurality of fluidic components which helps retain consistency and re-configurability of the continuous chemical processes with improved processing ability. More specifically, the invention relates to a multimodal micromixer composed of varied permutations and combinations of a plurality of modular elements for intensification of mixing and performing the reaction in a continuous manner.

BACKGROUND OF INVENTION

A continuous flow passive micromixer usually helps to achieve rapid mixing based on the geometry of the flow domain. It offers much faster mixing than the batch reactors for processing the same volume. This gives an advantage of better mixing, reduced mixing time, and consistency in the quality of mixed fluid thereby helping to achieve identical inlet conditions for reactions in a continuous reactor.

However, Continuous reactors usually are inflexible, less agile and not very prone to process modifications. Therefore, many multi-product manufacturing modules or plants prefer batch processing.

Converging diverging type mixers are one type of continuous mixer, which have not been widely explored to overcome this issue as it is typically perceived to be a ventury only. Prior exploration have been limited to only the converging section as mixer and residence time distribution for a tracer pulse has been used as a parameter to study the mixing performance.

But this option does not overcome the issues of moving from batch to continuous processing.

There have been attempts to improve micromixer designs. U.S. Pat. No. 7,753,580 discloses mixer apparatus which comprises at least one injection zone in a continuous flow path where plurality of fluids make initial contact. The injection zone has co-axial injection passage. The mixer elements comprise of a channel segment in the flow path. The channels lie on a first layer and a second layer. The channels in the first layer and the second layer are in perpendicular with each other. The mixer elements is further characterized by a chamber disposed at an end of said channel segment wherein each chamber further contains at least one obstacle. Further, the obstacle may preferably have a cylindrical shape. However, the obstacle may also take any geometrical shape and may be in series or parallel along the flow path to provide the desired flow-rate, mixing and pressure-drop.

U.S. Pat. No. 5,904,424 discloses a device for mixing liquids, The said device has at least two microchannels issuing from at least one inlet channel. Both of the microchannels are lying in the same branching plane. The device includes a confluence element connected by a connection to said microchannels. The said connection effects a 90° rotation of the inflow of the liquid relative to the branching plane as the liquid flows from the microchannels to the confluence element. However, the channel segments in U.S. '424 are the sections that connect the subsequent segments in a perpendicular manner and not in the same plane.

Further, an article titled "Mixing performance of a planar micromixer with circular obstructions in a curved microchannel" by Afroz Alam et. al. numerically investigates the mixing and fluid flow in a new design of passive micromixer employing several cylindrical obstructions within a curved microchannel. Mixing in the channels is analyzed using Navier-Stokes equations and the diffusion equation between two working fluids (water and ethanol) for Reynolds numbers from 0.1 to 60. The proposed micromixer of the said paper is claimed to be shown far better mixing performance than a T-micromixer with circular obstructions and a simple curved micromixer. The effects of cross-sectional shape, height, and placement of the obstructions on mixing performance and the pressure drop of the proposed micromixer have also been evaluated. However, these obstacles are placed in straight channels.

Another article titled "Design and Analysis of Y Shaped Micro-Mixer with Different Configuration of Obstacles" by Anil Shinde published in Sverian Scientific Vol. 1 April 2015 studies the mixing of two liquids in "Y" channel using Cosmol multyphysics, a commercial CFD tool. Obstacles located on the channel wall are used to enhance mixing in the channel, so as to reduce the mixing length. Micro channels with different geometric layout and with different shapes and sizes of obstacles such as rectangular, triangular and semicircular, are analyzed for their mixing length. The triangular obstacles within the "Y" channel gave minimum mixing length for the same distance between the obstacles.

The inventors of the present invention have attempted to improve the mixing efficiency further without affecting its agility.

OBJECT OF INVENTION

It is an object of the invention to provide a multimodal micro mixer that provides consistent mixing without affecting its agility.

SUMMARY OF THE INVENTION

In accordance with the object, the present invention provides novel modular reactor/micro mixer design that helps retain consistency and re-configurability of the continuous processes with better processing ability via intensification of mixing and reaction.

In an aspect, the present invention discloses a multimodal micromixer comprising plurality of inlets, an outlet and a plurality of channels wherein end channel comprises plurality of converging sections having width to depth ratio ranging 1:1 to 20:1, and intermediate channels having plurality of obstacles for intensification of mixing and performing the reaction in a continuous manner.

In a preferred embodiment, the obstacles may be non-circular, such as triangular, rectangular or any other non-circular shape. In another embodiment, the obstacles may have a non-cylindrical shape. The obstacles are placed in the intermediate channels only in order to enhance the mixing efficiency.

The micromixer may be metallic or non-metallic. It has a machined lamellar structure. The obstacles may have same or lower height than the depth of machined converging section.

In a preferred embodiment, the micromixer may have multi feed inlets. The inlet/injection ports are placed such that the axes of injection port are co-planar and perpendicular to the channel. The obstacles may be arranged in periodic or aperiodic sequence. The channels have serpentine nature.

In another embodiment, the periodic or aperiodic sequence may be of different shaped obstacles. For example, the sequence may include combination of triangular, rectangular and any other non-circular shaped obstacles.

In another aspect, the individual fluidic structures can have identical or different axis of symmetry.

DETAILED DESCRIPTION OF INVENTION

Figure 1:
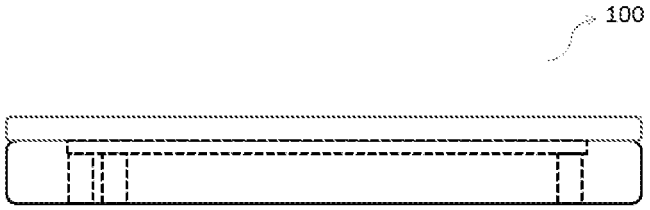
FIG. 1: Illustrates the assembled micromixer device.
Figure 2:
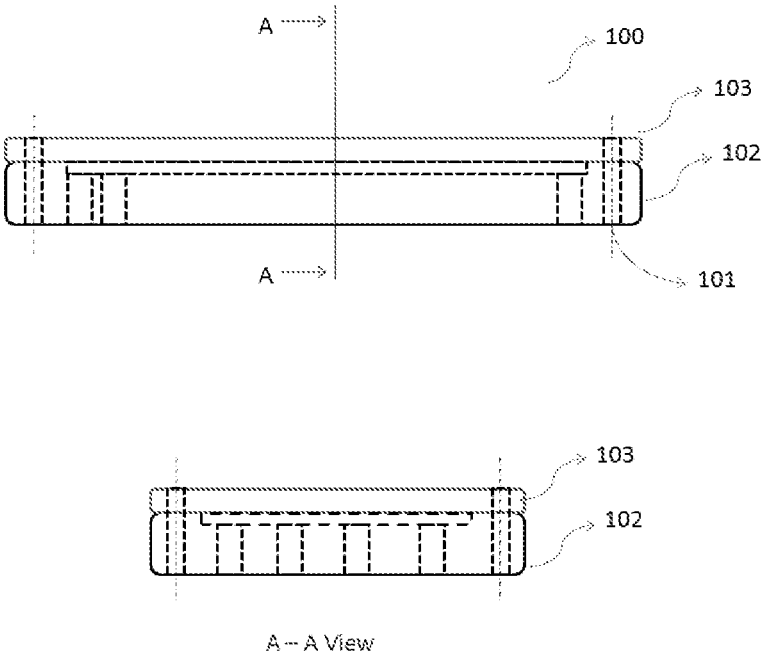
FIG. 2: illustrates side views of micromixer in FIG. 1.
Figure 3:
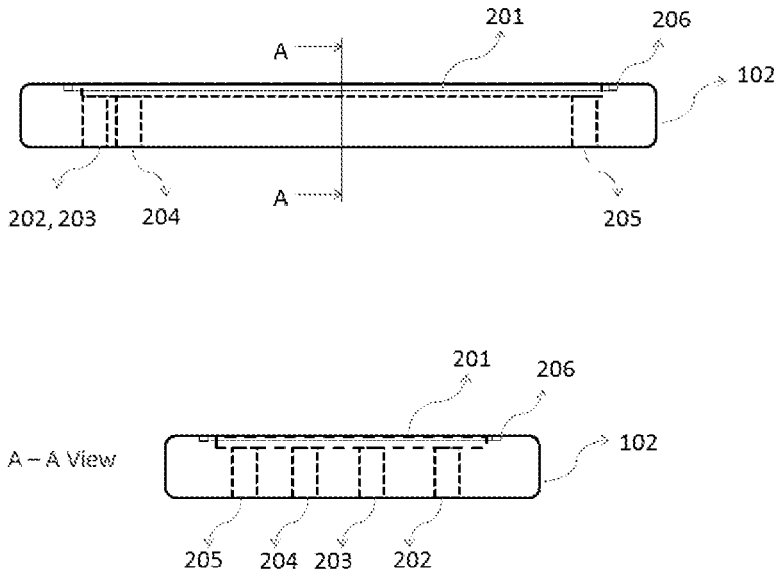
FIG. 3: Illustrates side view of the details of the machined bottom plate of micromixer in FIG. 1.
Figure 4:
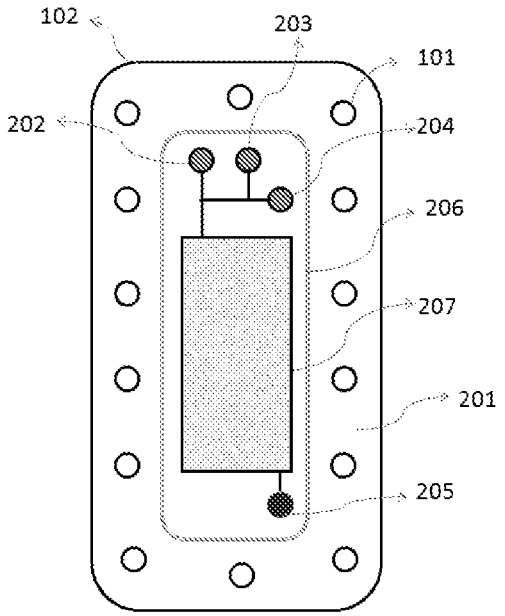
FIG. 4: Illustrates front view of the details of the machined bottom plate of micromixer in FIG. 1.
Figure 5:
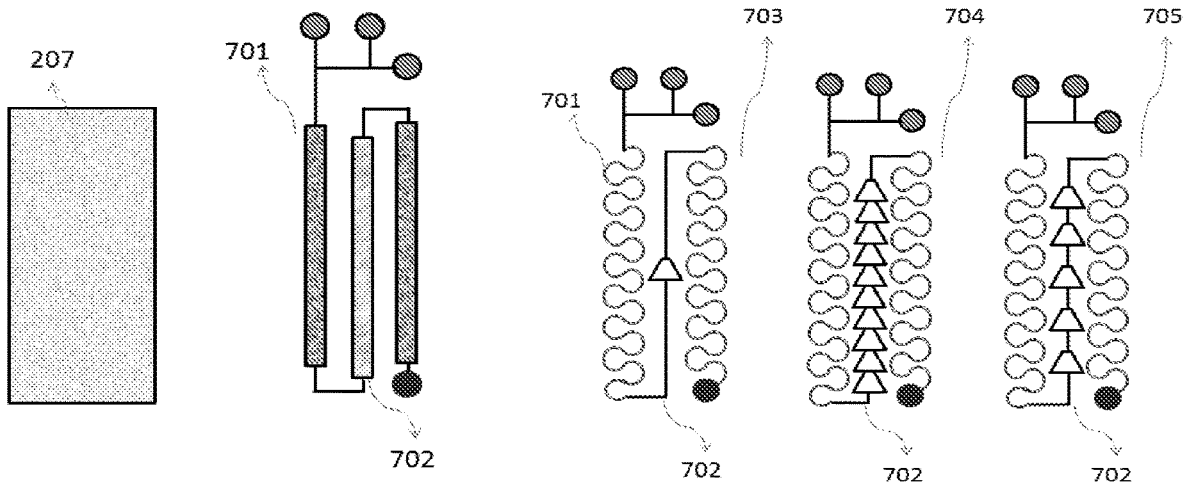
FIG. 5: Illustrates front view of the details of the mixing zone of the micromixer in FIG. 3.
Figure 6:
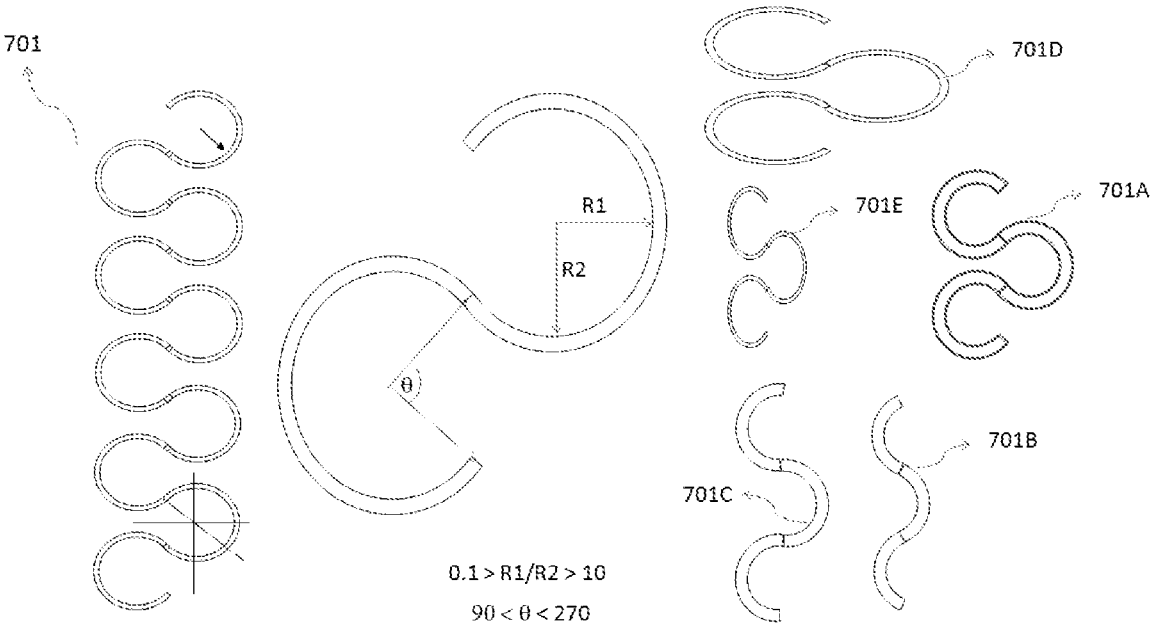
FIG. 6: Illustrates the lamellar structure [701] and its variants.
Figure 7:
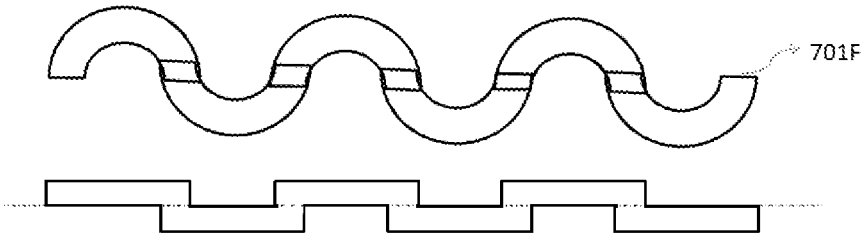
FIG. 7: Illustrates the split lamellar structure [701].
Figure 8:
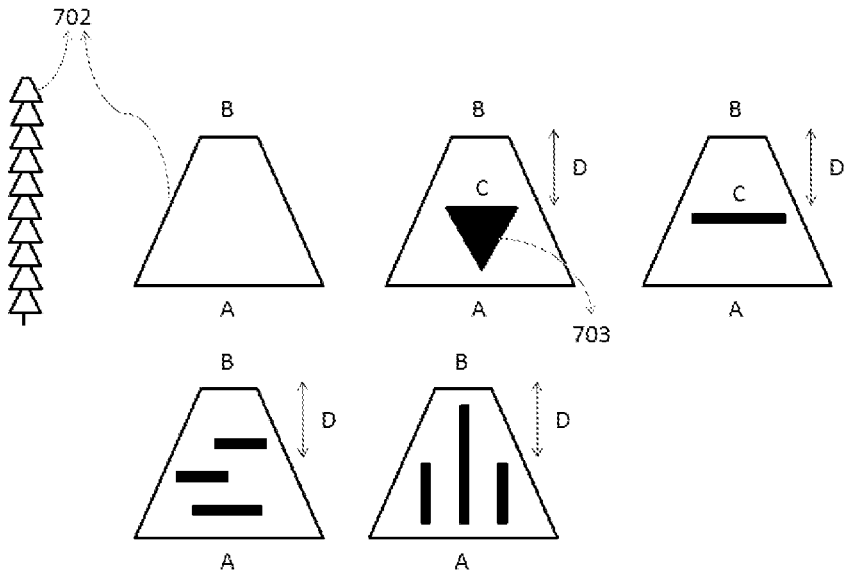
FIG. 8: Illustrates the various options of sharp edged converging section in the mixing zone of the micromixer in FIG. 3.

The present invention provides a continuous flow metallic or non-metallic micromixer assembly which comprises of mixing units having different planar features.

The continuous flow micromixer of the present invention retains agility and re-configurability of the continuous processes and also facilitates in achieving desired mixing time and enhancing mixing and reaction.

Accordingly, the present invention discloses a multimodal micromixer comprising plurality of inlets, an outlet and a plurality of channels wherein end channels comprise plurality of converging sections having width to depth ratio ranging 1:1 to 20:1, and intermediate channels having plurality of obstacles for intensification of mixing and performing the reaction in a continuous manner.

In a preferred embodiment, the obstruction may be non-circular, such as triangular, rectangular or any other non-circular shape. In another embodiment, the obstructions may have a non-cylindrical shape.

The micromixer may be metallic or non-metallic. It has a machined lamellar structure. The obstruction may have same or lower height than the depth of machined converging section.

In a preferred embodiment, the micromixer may have multi feed inlets. The inlet/injection ports are placed such that the axes of injection port are co-planar and perpendicular to the channel. The obstacles may be arranged in periodic or aperiodic sequence.

In another embodiment, the periodic or aperiodic sequence may be of different shaped obstacles. For example, the sequence may include combination of triangular, rectangular and any other non-circular shaped obstacles.

Each of the fluidic structures can be machined in metallic and non-metallic flat plates having respective inlet and outlet ports;

The selection of right combination of lamellar structures (radii of curvature, shape of cross-section, flow area, plane of machining and number of elements) and the converging unit (number of units, dimensions, type of obstruction, etc,) is decided upon the physicochemical properties of fluids to be mixed and the available pressure drop;

The micromixer having said plurality of machined fluidic structures achieves the desired residence time, extent of mixing, pressure drop and chemical reaction in a single phase or multiphase (gas-liquid, liquid-liquid, gas-liquid-liquid and such like) system is disclosed herein.

The individual fluidic structures can have identical or different axis of symmetry.

The invention will now be described in detail in connection with certain preferred and optional embodiments by way of figures, so that various aspects thereof may be more fully understood and appreciated. However, the figures are for the purpose of understanding the embodiments of the invention and should not be construed as limiting the scope of the invention. Any modifications in the embodiments may be considered as obvious to person skilled in the art.

With reference to FIGS. 1-9, the micromixer of the present invention comprises a plurality of channels, intermediate channels, plurality of inlets [202-204] being co-planar and perpendicular to the channels; and an outlet [205]. The end channels of said plurality of channels comprise of plurality of converging sections [702] having width to depth ratio ranging 1:1 to 20:1. The converging sections [702] are incomplete ellipse [701A-C], prolate [701D] or oblate [701E] shaped having angle of curvature in the range of 90 to 270°. The ratio of radii of curvature of incomplete ellipse, prolate or oblate shaped is in the range of 0.1:10. The intermediate channels have at least one obstacle [703] for intensification of mixing and performing the reaction in a continuous manner. The obstacle/s [703] in the intermediate channel have non-circular shape selected from triangular, rectangular or any such shape, The converging sections [702], the obstacles [703], the inlets [202-204] and the outlet [205] are co-planar.

The micro mixer [100] is a combination of two flat plates [102] and [103] joined face to face using screws or threaded nut-bolts through several end to end grooves [101].

The flat large surface of the bottom plate [102] facing the top plate is machined partly [201] and the system is made leak proof using an o-ring or gasket that can be held in the groove [206] machined on the same flat surface [102] and the machined section has four through holes [202-205] that open on the other side of the bottom plate [102A]. The holes [202-204] act as inlets while [205] acts as outlet.

The machined surface [201] of the bottom plate [102] includes a mixing zone [207] that occupies a substantial section of the machined area.

The bottom plate [102] and the holes [202-205] are either threaded or are smooth for connecting to metallic or non-metallic straight or flexible tubes with or without the help of external connectors.

The mixing zone [207] may be selected from one or a plurality of units selected from lamellar flow structures [701], or a sequence of sharp converging units [702] or such like arranged in varied permutations and combinations.

In another embodiment, the lamellar flow structures [701] comprises a cross section of geometries selected from circular, elliptical, square or rectangular or a combination of segments of an incomplete circle [701A-701C], specifically any geometry from quarter of a circle to ¾$^{th}$ of complete circle in the same plane. The individual lamella can have the shape of an incomplete ellipse, prolate [701D] or oblate [701E]. The ratio of radii of curvature of the two sides of any lamella (R1—major axis, R2—minor axis) can vary in the range of 0.1 to 10. The angle of curvature can vary in the range of 90° to 270°. The lamella having varied properties (radii, angle of curvature and diameter or cross-section shapes) can be arranged in varied permutations and combinations to achieve the desired length. The mixing zone may comprise of one or more rows of such combination of segments connected to each other.

In another embodiment of the lamellar flow structures [701], can have circular or elliptical or square or rectangular cross-section and can have a combination of segments of an incomplete circle [701A-701C], specifically any geometry from quarter of a circle to ¾$^{th}$ of complete circle in the same plane such that every alternate lamella is machined in two different plates [701F] i.e. top plate [103] and the bottom plate [102] with slight overlap to facilitate fluid transfer from one segment to other. The individual lamella can have the shape of an incomplete ellipse, prolate [701D] or oblate [701E]. The ratio of radii of curvature of the two sides of any lamella (R1—major axis, R2—minor axis) can vary in the range of 0.1 to 10. The angle of curvature can vary in the range of 90° to 270°. The lamella having varied properties (radii, angle of curvature and diameter or cross-section shapes) can be arranged in varied permutations and combinations to achieve the desired length. The mixing zone can comprise of one or more rows of such combination of segments connected to each other.

In a preferred embodiment, each of the elements of the sharp converging sections [702] may have non-cylindrical or non-circular obstacles [703] arranged in varied permutations and combinations. In one embodiment, the flow obstacles [703] comprise a triangular or rectangular shape. In another embodiment, the major axis of the rectangular shaped flow obstacles [703] is parallel or perpendicular to the flow direction.

In a preferred embodiment, the lamellar structure [701] is a sequence of 270° turns.

The micro mixer of the invention is useful used for carrying out the reactions selected from, but not limited to aromatic nitration (o-xylene, acetophenone, propiophenone, substituted aromatic ketones and such like), reactions involving diazonium salts and for Meerwein arylation reaction, reactions involving Bu-Li, flow synthesis of amino crotonates, sulfoxidation, and such others.

Residence time distribution for a tracer pulse was used as a method for exploring the nature of mixing in converging section of mixer. In addition to the converging sections, a sequence of diverging sections was also used as different mixer geometry. For the converging section the ratio of the length scale facing the fluid inlet is between 2 to 20, more specifically it was between 5 to 7.

Figure 9:
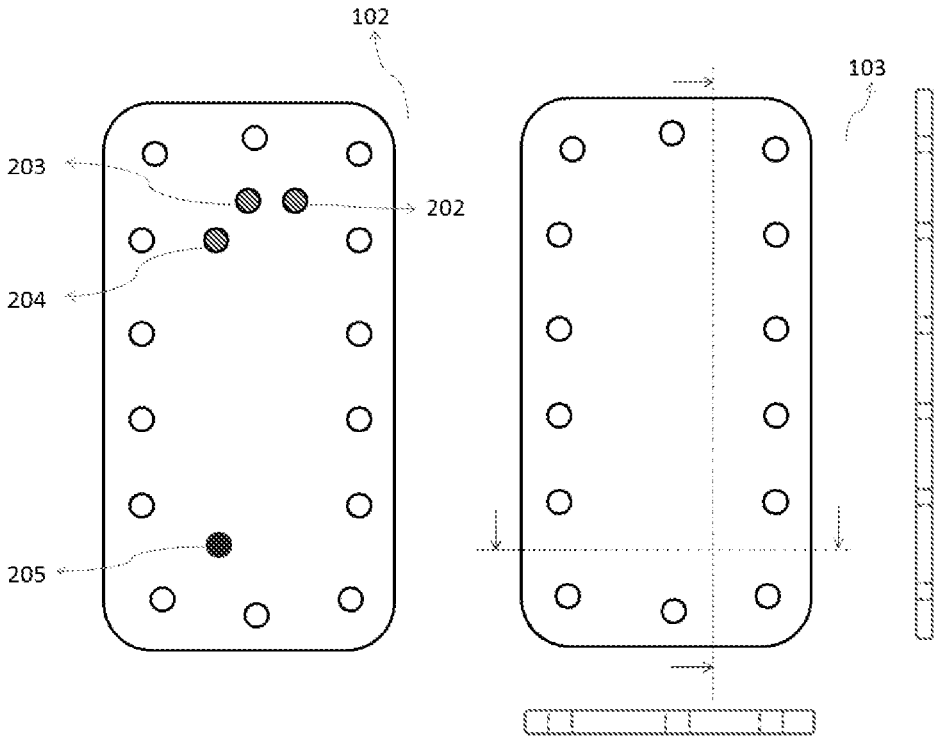
FIG. 9: Illustrates the front view of the bottom plate [102] and the top plate [103]

The RTD curves for the different sections of the micromixer are shown in FIG. 9. The extent of dispersion only from the middle section comprising of converging two dimensional units (FIG. 9A) is quite wide as compared to the lamellar section (FIG. 9B) indicates that it is necessary to have the lamellar sections sandwiching the middle section to reduce the dispersion and also enhance mixing. The overall tracer outlet was close to Guassian indicating that the extent of dispersion was close to a plug flow reactor, which is desired.

Figure 10:
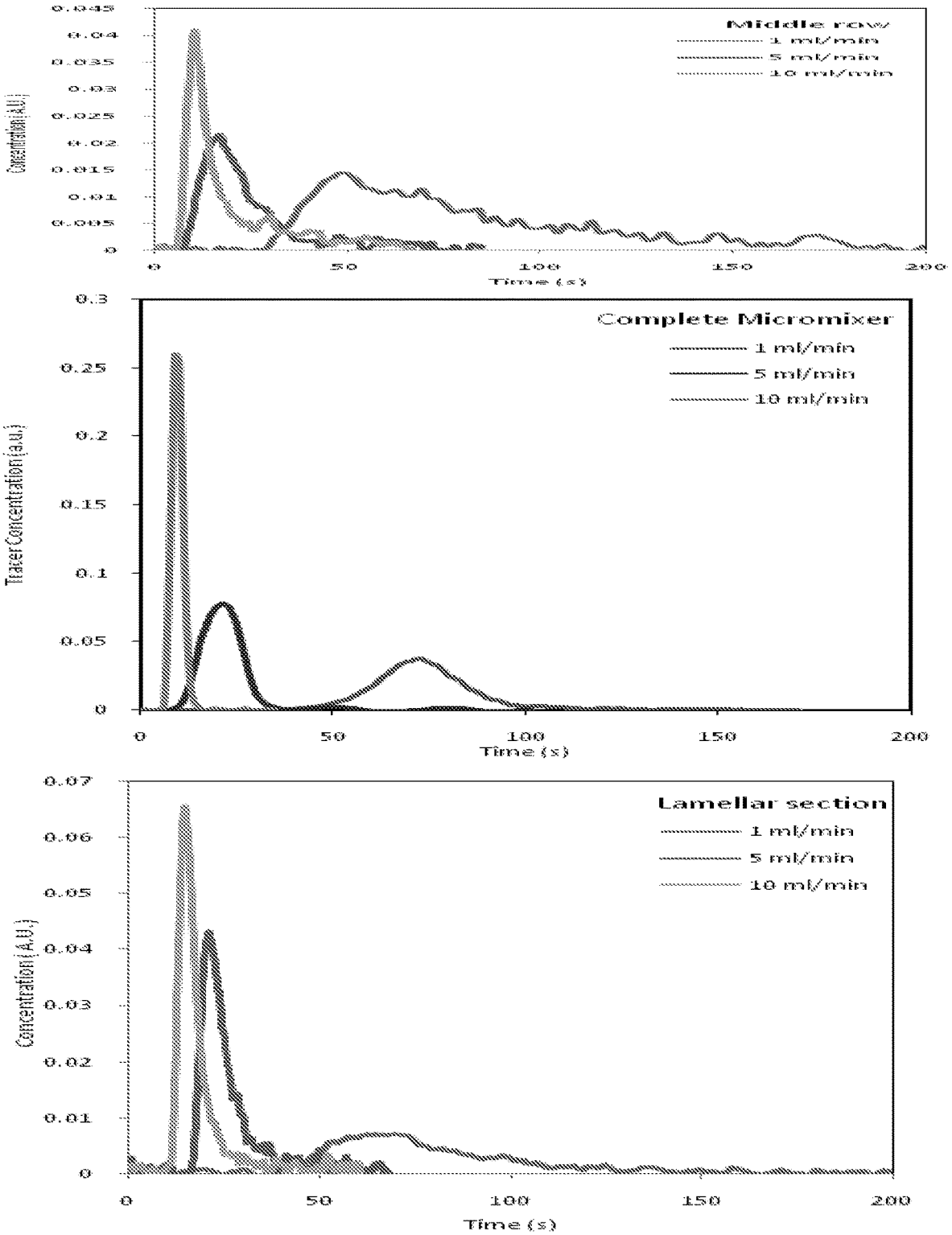
FIG. 10: RTD for the instant device and the sequence of middle converging section of the micro mixer alone

FIGS. 10A, 10B and 10C illustrate the effect of power consumption per unit volume on the mixing time for single phase and two phase flow in lamellar channels in a geometry with fixed turn-around angle. Mixing time was seen to decrease with increasing flow rate or the power consumption in the micromixer. The trends were identical for single phase as well as two-phase systems. This is standard for a good micromixer and indicates that constant extent of mixing can be achieved with higher power or flow rates in shorter time.

Following examples are given by way of illustration and therefore should not be construed to limit the scope of the invention.

EXAMPLES

Example 1: Mixing Uniformity

The extent of mixing was analyzed by mixing blue and red colours. The images of the micromixer at different flow rates (0.5 ml/min, 1 ml/min, 2 ml/min, 5 ml/min, 10 ml/min, 20 ml/min) are given in FIG. 12 which shows the pictorial view of the mixing quantification. It can be seen that in the first lamellar section mixing takes place only to some extent and it enhances rapidly when the type of mixing changes from lamellar mixing to split and recombine type of mixing. Later the second lamellar section ensures that complete mixing is achieved. From top to bottom the pictures correspond to different flow rates.

Example 2: Extent of Dispersion

Figure 11:
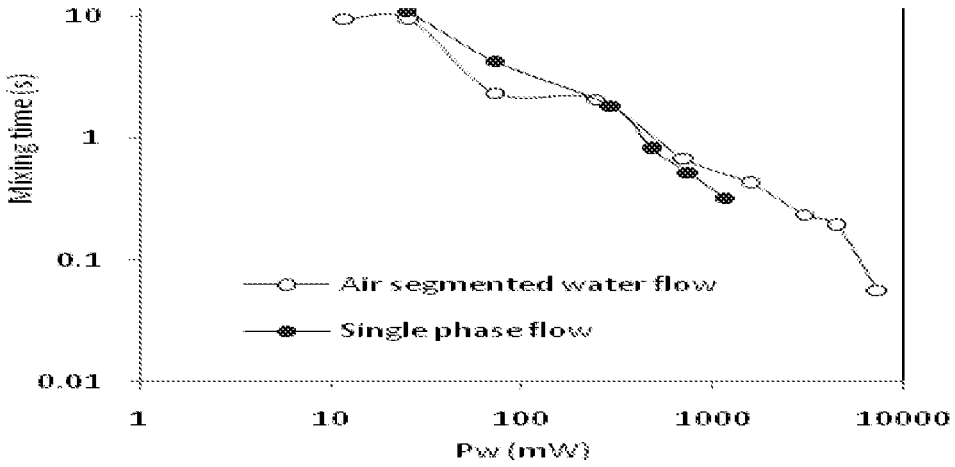
FIG. 11: Effect of Re on the mixing time for single phase and two phase flow in lamellar channels in a geometry with fixed turn-around angle.
Figure 12:
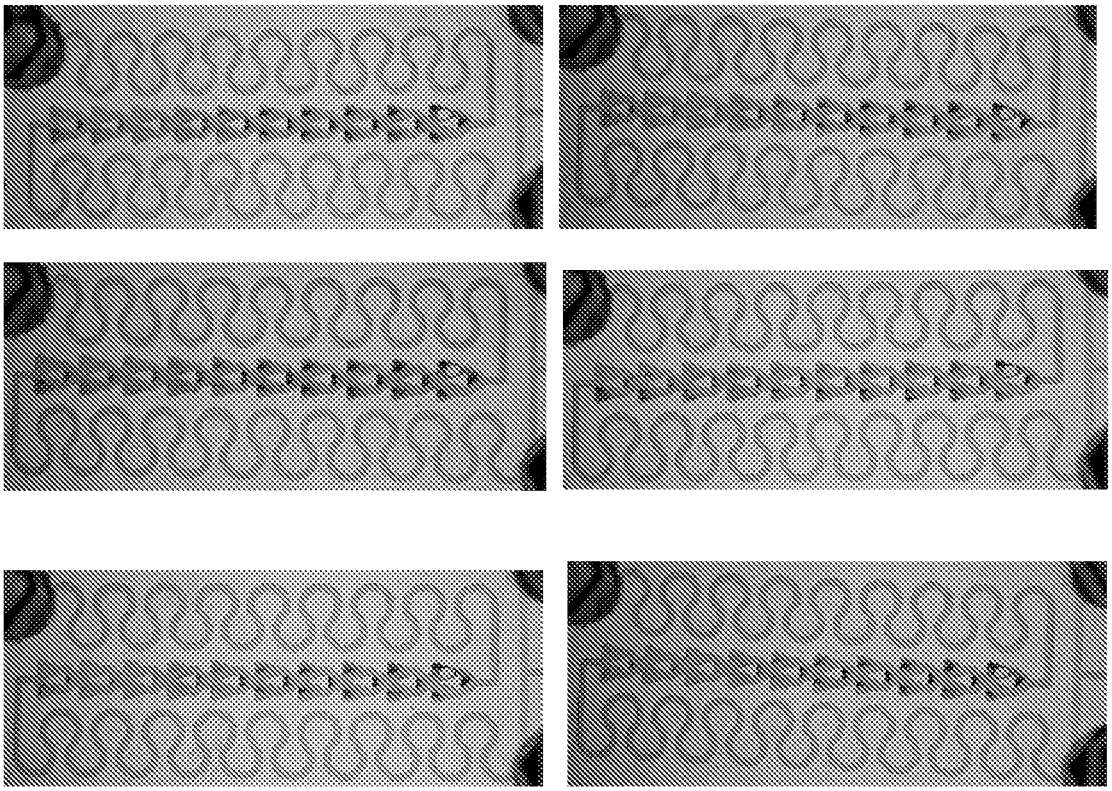
FIG. 12: The extent of mixing was analyzed by mixing blue and red colours. The images of the micro mixer at different flow rates (0.5 ml/min, 1 ml/min, 2 ml/min, 5 ml/min, 10 ml/min, 20 ml/min)

Residence time distribution for a tracer pulse was used as a method for exploring the nature of mixing in converging section of mixer. In addition to the converging sections, a sequence of diverging sections was also used as different mixer geometry. For the converging section the ratio of the length scale facing the fluid inlet is between 2 to 20, more specifically it was between 5 to 7. When fluids flow through curvilinear channels, they experience inertial forces acting to direct axial motion and centrifugal forces acting along the radius of curvature. When the fluid flows through the lamellar channels, a mismatch of velocity between the fluid in the centre and the fluid near the wall region causes secondary flows. Fluid elements at the channel centreline tend to flow outward around the curve and since the channel is enclosed, the fluid near the walls re circulates inward creating two symmetric vortices. The residence time distribution (RTD) which actually indicates the extent of dispersion in the system were measured for the complete device and also the sequence of middle converging section of the micro mixer alone. The RTD curves are illustrated in FIGS. 11 and 12.

Example 3: Flow Synthesis

Reaction of bromobenzene in acetic acid (bromobenzene to acetic acid volume ratio was kept at 1:15.) with nitrating mixture (60:40 v/v, 68% $HNO_3$ & $H_2SO_4$ respectively) was carried out with the micromixer followed by residence time tube. Complete conversion was achieved at 30° C. and residence time of 60 minutes. Para to ortho isomer ratio was 2.82.

Example 4: Flow Synthesis

Reaction of bromobenzene in acetic acid (bromobenzene to acetic acid volume ratio was kept at 1:15.) with nitrating mixture (60:40 v/v, 68% $HNO_3$ & $H_2SO_4$ respectively) was carried out with the micromixer followed by residence time tube. Complete conversion was achieved at 80° C. and residence time of 15 minutes. Para to ortho isomer ratio was 2.82.

We claim:

1. A multimodal micromixer comprising a plurality of inlets, an outlet, and a plurality of channels, said plurality of channels having a serpentine nature, wherein end channels of said plurality of channels comprise a plurality of converging sections having width to depth ratio ranging 1:1 to 20:1, a plurality of lamellar flow structures, and intermediate channels having at least one obstacle for intensification of mixing and performing the reaction in a continuous manner and said each lamellar flow structure comprises lamella segments having an incomplete ellipse, prolate or oblate shape with an angle of curvature in the range of 90 to 270°, wherein the lamella segments are machined into two different plates disposed in different planes with every alternate lamella segment shifting planes with a slight overlap to facilitate fluid transfer from one lamella segment to the next lamella segment.

2. The multimodal micromixer according to claim 1, wherein ratio of radii of curvature of a major axis and a minor axis of the lamella segments is in the range of 0.1 to 10.

3. The multimodal micromixer according to claim 1, wherein said obstacle in said intermediate channel has a polygonal cross-section.

4. The multimodal micromixer according to claim 1, wherein said obstacles as well as said converging sections are arranged in periodic or aperiodic sequence.

5. The multimodal micromixer according to claim 1, wherein intermediate channels having said obstacles have sharp comers.

6. The multimodal micromixer according to claim 1, wherein axis of said inlets are co-planar and perpendicular to said channels.

7. The multimodal micromixer according to claim 1, wherein said converging sections, said obstacles, said inlets and said outlet are co-planar.

8. A multimodal micromixer comprising a plurality of channels, lamellar flow structures, and intermediate channels, wherein end channels of said plurality of channels comprise plurality of converging sections having width to depth ratio ranging 1:1 to 20:1, wherein said lamellar flow structures comprise lamella segments having an incomplete ellipse, prolate or oblate shape with an angle of curvature in the range of 90 to 270°, wherein the lamella segments are machined into two different plates disposed in different planes with every alternate lamella segment shifting planes with a slight overlap to facilitate fluid transfer from one lamella segment to the next lamella segment; a ratio of radii of curvature of a major axis and a minor axis of the lamella segments is in the range of 0.1 to 10; said intermediate channels having at least one obstacle for intensification of mixing and performing the reaction in a continuous manner; said obstacle in said intermediate channel has a polygonal cross-section, plurality of inlets being co-planar and perpendicular to said channels; and an outlet wherein said converging sections, said obstacles, said inlets and said outlet are co-planar.

* * * * *